US005722595A

United States Patent [19]

Parisi

[11] Patent Number: 5,722,595

[45] Date of Patent: Mar. 3, 1998

[54] GRIP ASSEMBLY

[75] Inventor: Bernard Parisi, Barnegat, N.J.

[73] Assignee: Component Hardware Group, Inc.

[21] Appl. No.: 549,918

[22] Filed: Oct. 30, 1995

[51] Int. Cl.[6] ..... B05B 1/28

[52] U.S. Cl. ..... 239/288; 239/525; 239/530; 138/109

[58] Field of Search ..... 239/75, 288, 525, 239/530; 138/109, 112–114

[56] References Cited

U.S. PATENT DOCUMENTS

| | | | |
|---|---|---|---|
| 1,724,161 | 8/1929 | Westhoff | 239/75 |
| 2,061,987 | 11/1936 | Sorensen | 239/141 |
| 2,185,741 | 1/1940 | Sorg et al. | 138/61 |
| 2,616,660 | 11/1952 | Morehouse | 251/163 X |
| 2,971,520 | 2/1961 | Motis et al. | 134/172 |
| 3,120,966 | 2/1964 | Lyon | 285/116 |
| 3,556,410 | 1/1971 | Arant | 239/525 |
| 4,003,407 | 1/1977 | Finger | 138/112 |
| 4,410,013 | 10/1983 | Sasaki et al. | 138/113 |
| 4,901,922 | 2/1990 | Kessener et al. | 239/75 |
| 5,145,114 | 9/1992 | Mönch | 239/126 |
| 5,263,646 | 11/1993 | McCauley | 239/154 |
| 5,624,074 | 4/1997 | Parisi | 239/588 |

*Primary Examiner*—Andres Kashnikow
*Assistant Examiner*—Lisa Ann Douglas
*Attorney, Agent, or Firm*—McAulay Fisher Nissen Goldberg & Kiel, LLP

[57] ABSTRACT

The grip assembly is made of two members each of which is formed of a plastic. A one piece base member forms a barrel having a radial shoulder at one end and a radial flange at the opposite end. A cover member telescopes over the base member and is received at the respective ends on the shoulder and on the flange of the base member in a locked relation. The base member has an internally threaded collar at one end for receiving a threaded stem of a spray head unit while the opposite end is provided with an externally threaded stem to thread into a fitting of a hose assembly. A relatively large annular chamber is provided between the cover and the base member for insulation purposes to protect the user against the heat of hot water flowing through the grip assembly.

21 Claims, 3 Drawing Sheets

GRIP ASSEMBLY

This invention relates to a grip assembly. More particularly, this invention relates to a grip assembly for a spray head assembly.

As is known, various types of spray head assemblies have been employed for the rinsing and washing of dishes, utensils, pots, pans and the like in sinks in commercial and institutional establishments. In many cases, hot water is delivered from a tap through a flexible hose to a spray head which can be manipulated by a user into an area of a sink in which hot spray water is required. In many cases, the hot water is delivered via a rubber hose or the like directly into the spray head. As a result, the spray head becomes heated by the hot water. In some cases, a spray head may become heated to such an extent that the user is not able to grasp the spray head without running a risk of being burnt.

In order to reduce the risk of burns, spray head assemblies have been known to employ an insulated grip between the hose and the spray head to allow the user to grasp the grip in order to direct the spray head to the appropriate area of a sink. Generally, these known grips have been constructed to form a passage for the hot water with an annular chamber surrounding the passage to function as an insulation barrier. The intent of such grips is to reduce the heat transfer from the hot water through the grip to the outside surface of the grip. These grips have generally been made of five or more components and thus have been relatively expensive to manufacture. In addition, the amount of heat insulation provided has usually been at a relative minimum because the annular insulation chambers have usually been relatively small.

Accordingly, it is an object of the invention to provide a grip for a spray head assembly which is made of a minimum of parts.

It is another object of the invention to provide a grip assembly which has relatively high heat insulation properties.

Briefly, the invention provides a grip assembly particularly for a spray head unit which is comprised of two members, namely a one piece base member and a one-piece tubular cover member.

The one piece base member is constructed with a barrel which defines a bore for the passage of water. In addition, the base member has a radially directed shoulder at one end of the barrel and a radially directed flange at an opposite end of the barrel.

The cover member is telescopically disposed over the base member with one end disposed on the shoulder of the base member and an opposite end disposed on the flange of the base member. In addition, the cover member is radially spaced from the barrel in order to define an annular chamber therewith.

In order to assemble the grip assembly, the cover member is slid over the base member from the flange end. The relative sizes of the base member and the cover member are such that one end of the cover member is fitted onto the shoulder of the base member which is of slightly larger outer dimension while the opposite end comes into an interference-fit locking relation with the annular flange of the base member. In this way, once the cover member is slid into place, the cover member is intended to remain in place in a permanent manner.

The base member is further provided with an internally threaded collar or other means at one end for connecting with a spray head unit to deliver water thereto. In addition, the opposite end of the barrel is provided with an externally threaded stem or other means so as to be coupled to a hose assembly to receive water.

Typically, the two members of the grip assembly are made of plastic so as to reduce any heat transfer between the water flowing through the bore of the barrel and the outside surface of the cover member. In addition, the annular chamber defined by the barrel of the base member and the cover member is relatively large so as to further insulate the holder from the hot water flowing through the bore of the barrel.

Each end of the base member may also be provided with an annular groove so as to receive a sealing ring such as an O-ring, for sealing against the hose assembly and the spray head unit, respectively.

In addition, the base member may be provided with a radially directed rib at an intermediate point to slidably receive the cover member thereon. This annular rib also serves to divide the annular chamber between the barrel and the cover member into two sub-chambers while at the same time providing an intermediate support for the cover member.

These and other objects and advantages of the invention will become more apparent from the following detailed description taken in conjunction with the accompanying drawings wherein.

Figure 1:
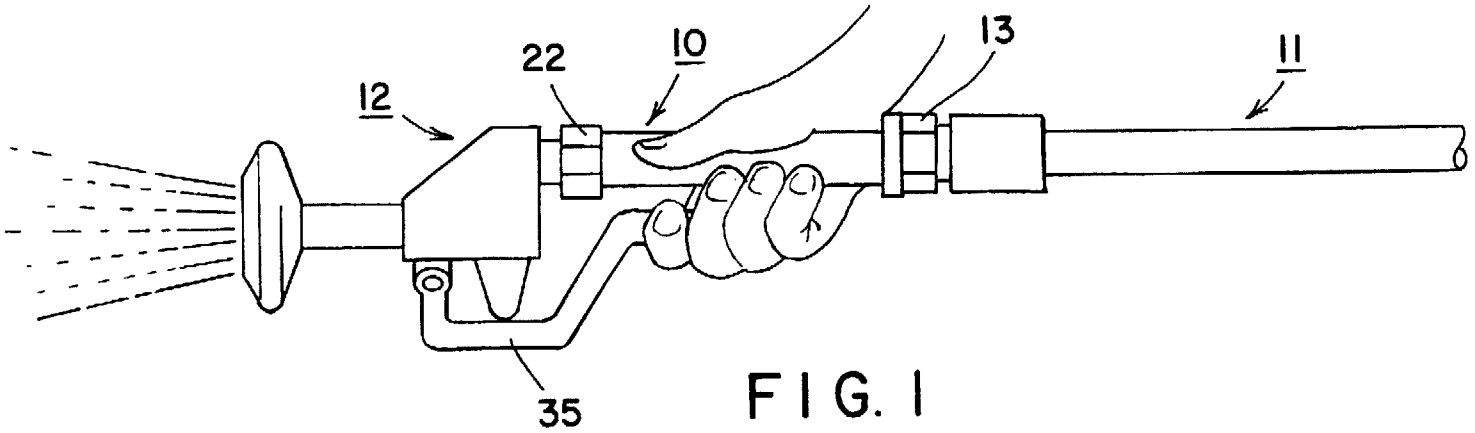
FIG. 1 illustrates a grip assembly coupled between a hose assembly and a spray head unit in accordance with the invention.

Referring to FIG. 1, the grip assembly 10 is provided between a hose assembly 11 and a spray head unit 12. As indicated, the hose assembly 11 has a fitting 13 or other suitable means at one end for delivering water to the grip assembly 10 while the spray head unit 12 is of a conventional structure for spraying steams of water therefrom.

Figure 2:
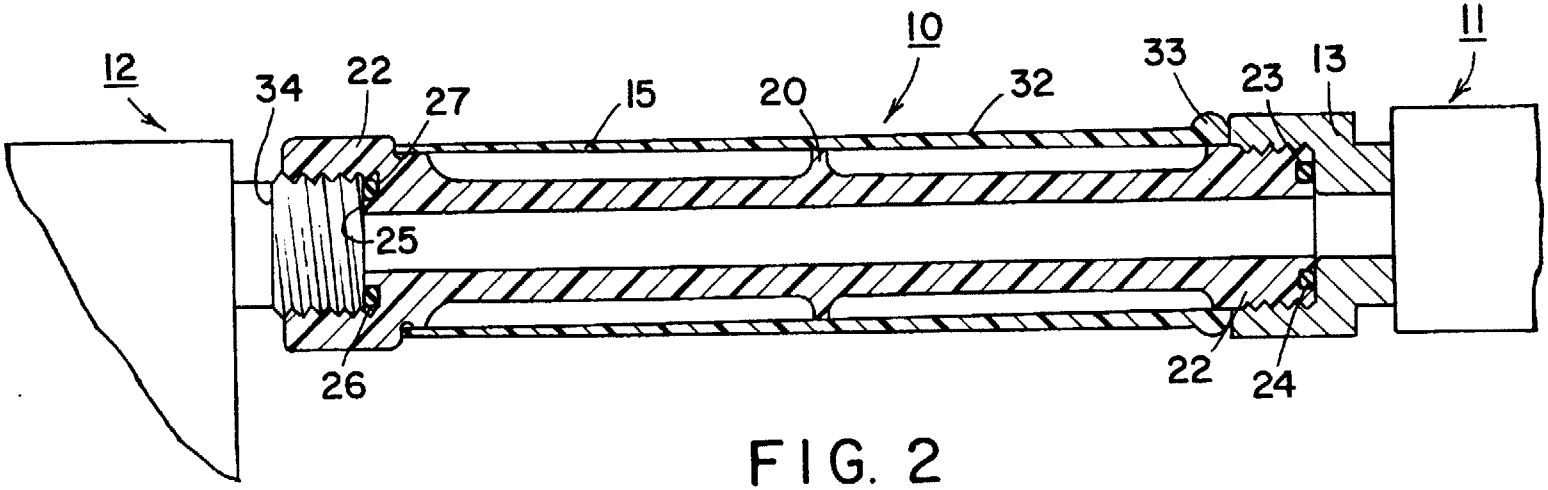
FIG. 2 illustrates a cross-sectional view of the grip assembly of FIG. 1.
Figure 3:
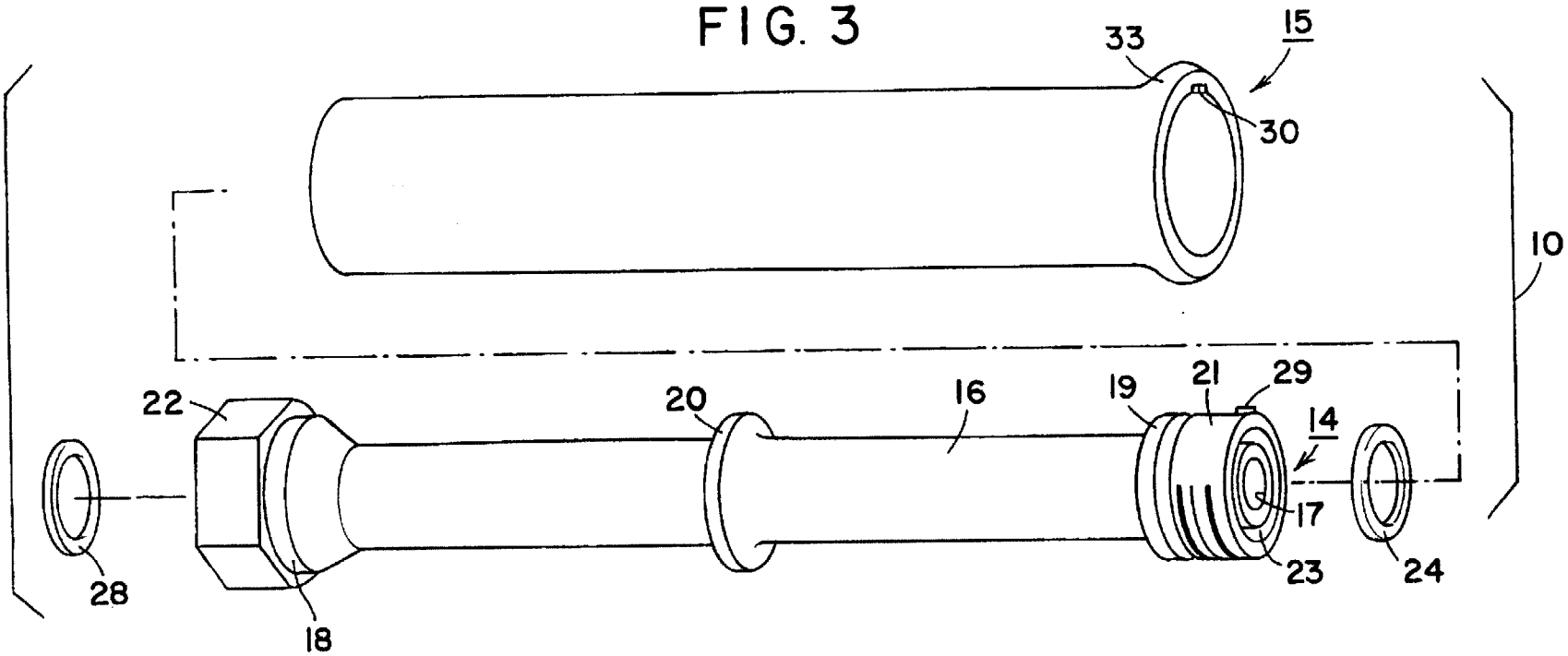
FIG. 3 illustrates an exploded view of the grip assembly of FIGS. 1 and 2 in accordance with the invention.

Referring to FIGS. 2 and 3, the grip assembly 10 is formed of two members, namely, a one-piece base member 14 and a one-piece cover member 15, each of which is made of a suitable plastic material.

Referring to FIG. 3, the base member 14 has a barrel 16 which defines a bore 17 for the passage of water, such as a flow of hot water. In addition, the base member 14 has a radially directed shoulder 18 at the discharge end of the barrel 16 and a radially directed flange 19 at the opposite inlet end of the barrel 16. A radially directed rib 20 is also provided at an intermediate point of the barrel 16.

Still further, the base member 14 which constitutes a tubular member has an externally threaded stem 21 at the inlet end of the barrel 16 and an internally threaded enlarged collar 22 at the opposite discharge end of the barrel 16. As indicated, the collar 22 is provided with a polygonal contour, for example, of hexagonal shape similar to that of a nut. The shoulder 18 which is adjacent to the collar 22 may merge directly into the collar 22 or may be spaced therefrom by an annular groove (not shown). The annular flange 19 may, in similar fashion, be directly adjacent to the end of the threaded stem 21 or may be separated therefrom by an annular groove (not shown).

Referring to FIG. 2, the threaded stem 21 is provided with an annular groove 23 in an end wall which receives a sealing ring, such as an O-ring 24. In a similar fashion, the barrel 16 has an end wall 25 at the discharge end which is recessed within the collar 22 and which has an annular groove 26 for receiving a sealing ring, such an O-ring 27.

The cover member 15 is also a tubular member and is telescopically mounted over the base member 14. In this respect, the cover member 15 is radially spaced from the barrel 16 to define an annular chamber 28 therewith while the rib 20 of the barrel 16 divides the chamber into two sub-chambers. As shown, the cover member 15 has one end disposed on the annular shoulder 18 of the base member 14 while the opposite end is disposed on the flange 19 in an interference-fit relation.

Figure 5:
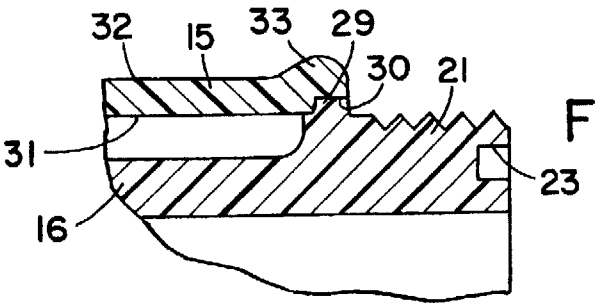
FIG. 5 illustrates an enlarged detailed view of the interference-fit connection between the base member and cover member of the grip assembly in accordance with the invention.
Figure 4:
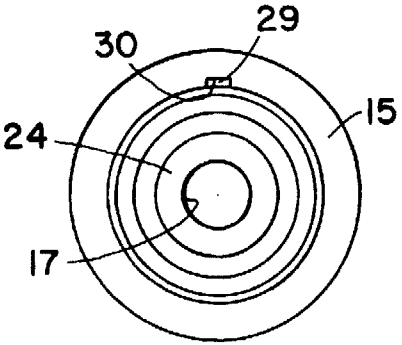
FIG. 4 illustrates an end view of the grip assembly taken from the hose assembly end.

In order to ensure against relative rotation between the two members 14, 15 and to further lock the members 14, 15 together, the flange 19 of the base member 14 is provided with a projection 29 as shown in FIGS. 4 and 5 while the cover member 15 is provided with a recess 30 at the end to receive the projection 29 in interfitting relation.

The cover member 15 is provided with an annular interior wall 31 (see FIG. 5) which has a larger inside diameter at the end mounted on the shoulder 18 than at the opposite end which is mounted on the flange 19 in order to permit sliding of the cover member 15 over the base member 14 from the flange end. In this respect, the interior wall 31 is tapered from one end to the opposite end. Alternatively, the interior wall may be of a stepped configuration between the two ends.

The interior wall 31 of the cover member 15 may also have a roughened surface (not shown) at the inlet end for engaging on the flange 19.

As indicated in FIG. 2, the cover member 15 also has an outer wall 32 which has a slightly smaller outside diameter at the end adjacent the collar 22 than at the opposite inlet end. In addition, the cover member 15 has an outwardly directed flange 33 at the inlet end which acts as a stop for reasons as described below.

In order to assemble the grip assembly 10, the cover member 15 is telescoped over the base member 14 from the threaded stem end. Sliding of the cover member 15 continues until a point is reached at which the discharge end of the cover member 15 is slightly spaced from the annular shoulder 18. At this time, the inlet end of the cover member 15 begins to frictionally engage the annular flange 19. The recess 30 in the end of the cover member 15 is then aligned with the projection 29 on the base member 14 and a force is then imposed on the cover member 15 to force the cover member 15 onto shoulder 18 and to abut against the collar 22. At this time, the inlet end of the cover member 15 is moved into an interference-fit relation with the annular flange 19 and the projection 29 snaps into the recess 30. In this respect, the cover member 15 is of a length to allow the threaded stem 21 to extend beyond the cover member 15.

The cover member 15 is intended to be locked in place when mounted on the base member 14. However, modifications may be made so that the cover member 15 may be removed from the base member 14 by using a slide fit or friction fit arrangement.

In order to enhance the locking relation between the base member 14 and the cover member 15, the annular shoulder 18 has a slightly larger diameter than the intermediate rib 20 and the flange 19. The cover member 15, in turn, is provided with an internal diameter at the discharge end which is slightly smaller than the outside diameter of the shoulder 18 so as to allow for an interference fit therewith while the inlet end of the cover member 15 has an internal diameter which is equal to the outside diameter of the flange 19 so as to provide an interference-fit. Likewise, the intermediate rib 20 may have a larger outside diameter than the inside diameter of the cover member 15 at that point. In this way, the rib 20 also provides an interference fit with the cover member 15. Thus, once the cover member 15 has been slid into place, the cover member 15 is slightly enlarged at the discharge end by the shoulder 18 and is slightly enlarged by the rib 20.

Thereafter, with the sealing rings 24, 27 in place, the grip assembly 10 may be connected to the hose assembly 11 and the spray head unit 12.

As indicated in FIG. 2, the threaded stem 21 of the grip member 10 is threaded into an internally threaded fitting 13 of the hose assembly 11 while the collar 22 threadably receives an externally threaded stem 34 on the spray head unit 12.

When in use, hot water is delivered through the hose assembly 11 through the bore 17 of the barrel 16 and, in turn, into the spray head unit 12. As indicated in FIG. 1, the spray head unit 12 has a handle 35 which can be manually manipulated by a user in order to activate the spray head unit 12.

During use, the user grasps the grip assembly 10 while at the same time holding onto the handle 35 in order to actuate the spray head unit 12 and to direct sprays of water from the spray head unit 12 to a desired location. The annular flange 33 on the cover member 15 of the grip assembly 10 serves as a stop against which the hand of the user may abut during use.

The grip assembly 10 provides a relatively large chamber between the barrel 16 of the base member 14 and the cover member 15 so that the insulation characteristics of the grip assembly are enhanced over previously known grip assemblies.

The annular chamber 28 formed by the base member 14 and cover member 15 is relatively large without being cumbersome. For example, the cover member may have a length of about 4.5" and an outside diameter of about 1" to comfortably fit within a user's hand. The barrel 16 of the base member 14 may have a bore of about 0.5" and an outside diameter of 0.64". The annular chamber 28 may thus have a length of about 4.4" and an annular height which tapers from about 0.25 inch at one end to 0.12 inch at an opposite end.

Figure 6:
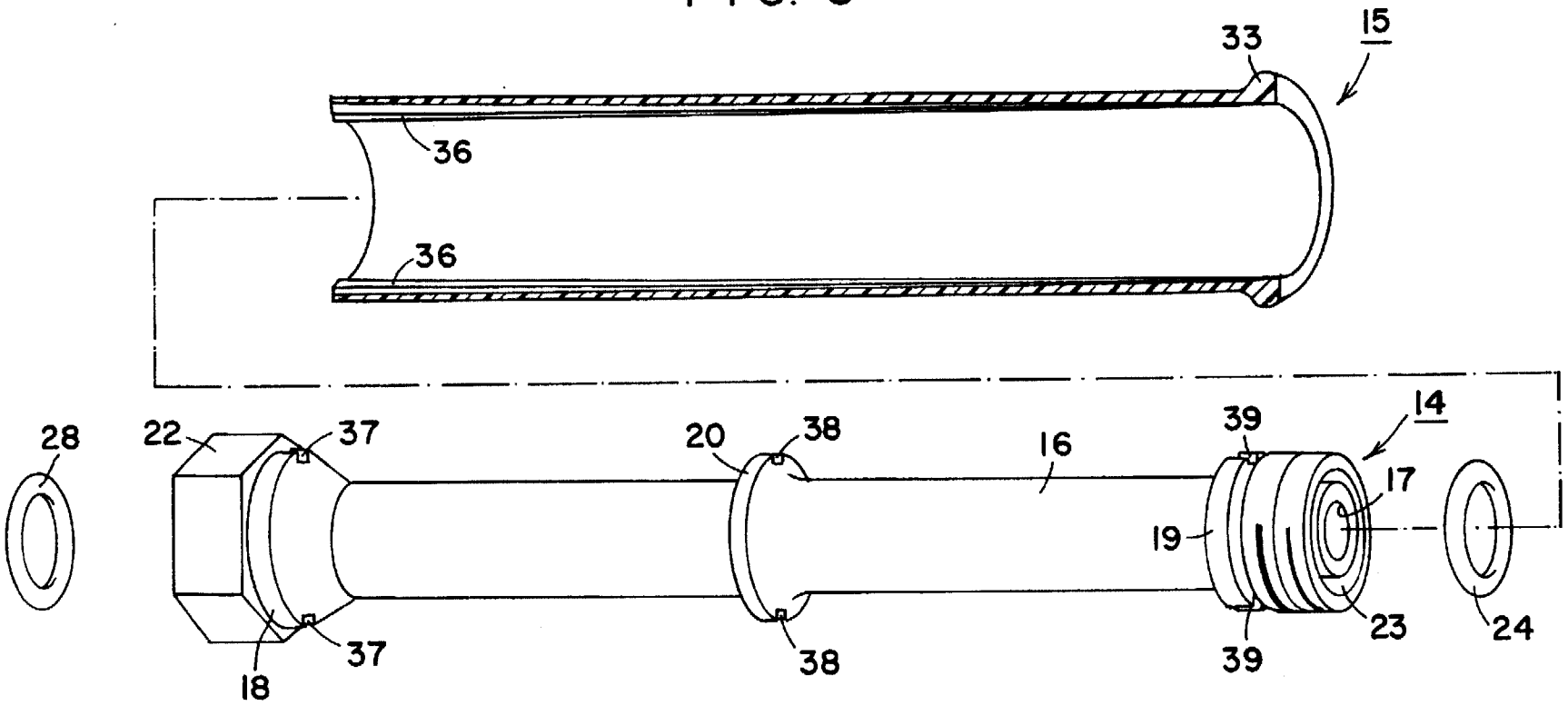
FIG. 6 illustrates an exploded view of a modified grip assembly in accordance with the invention.

Referring to FIG. 6, wherein like reference characters indicate like parts as above, instead of using a projection 29 and recess 30 as described above to ensure against relative rotation between the members 14, 15, the cover member 15 may be provided with a pair of internally disposed longitudinal ribs 36. Each rib 36 extends from one end of the member 15 to the opposite end while being of decreasing height relative to the member 15 in the proximal end, i.e. the right-hand as viewed in FIG. 6, so that the ribs 36 feather into the interior surface of the member 15 at the proximal end. The shoulder 18 of the member 14 is provided with a pair of diametrically opposed slots 37 to receive the distal ends of the respective ribs 36. Likewise, the radially directed rib 20 is provided with a pair of diametrically opposed slots 38 to receive the ribs 36 and the flange 19 is provided with a pair of diametrically opposed slots 39 to receive the respective ribs 36.

When the member 15 is slid over member 14, the ribs 36 initially pass through the slots 39 of the flange 19. Continued movement of the member 15 over the member 15 causes the ribs 36 to pass through the slots 38 of the rib 20 and into the slots 37 of the shoulder 18. The interengagement of the ribs and slots prevents the members 14, 15 from rotating relative to each other.

The invention thus provides a grip assembly which can be fabricated of a minimum of parts thereby reducing the overall costs of production and assembly.

What is claimed is:

1. A grip assembly for a spray head assembly, said grip assembly comprising a one piece base member having a barrel defining a bore for passage of hot water therethrough, an eternally threaded stem at one end of said barrel, a radially directed flange adjacent said stem, and an internally threaded enlarged collar at an opposite end of said barrel; and a one piece cover member telescopically disposed over said base member, said cover member being radially spaced from said barrel of said base member to define an annular chamber therebetween and having said threaded stem of said base member extending therefrom.

2. A grip assembly as set forth in claim 1 wherein said base member includes an annular shoulder adjacent said collar and an annular rib disposed intermediately of said shoulder and said flange, and wherein said cover member is mounted on said shoulder to abut said collar and mounted on said rib.

3. A grip assembly as set forth in claim 2 wherein said cover member is secured on and to said flange in an interference fit relation.

4. A grip assembly as set forth in claim 3 wherein said flange has a radially directed projection thereon and said cover member has an internal recess receiving said projection to prevent rotation of said cover member relative to said base member.

5. A grip assembly as set forth in claim 1 wherein said barrel of said base member has an end wall concentrically within said collar with an annular groove in said end wall.

6. A grip assembly as set forth in claim 5 which further comprises an O-ring in said annular groove.

7. A grip assembly as set forth in claim 5 wherein said stem has an annular groove concentric to said bore and which further comprises an O-ring in said groove in said stem.

8. A grip assembly for a spray head assembly, said grip assembly comprising a first tubular member having a barrel defining a bore for passage of hot water therethrough, an externally threaded stem at one end of said barrel, a radially directed flange adjacent said stem, an internally threaded enlarged collar at an opposite end of said barrel, an annular shoulder adjacent said collar, and an annular rib disposed intermediately of said shoulder and said flange; and a second tubular member telescopically disposed over said first tubular member and mounted on said shoulder and said rib, said second tubular member being radially spaced from said barrel of said first tubular member to define an annular chamber therebetween and having said threaded stem of said first member extending therefrom, said second tubular member having an annular interior wall, said wall having a larger inside diameter at one end adjacent said collar than at an opposite end adjacent said flange to permit sliding of said one end of second tubular member over said flange.

9. A grip assembly as set forth in claim 8 wherein said second tubular member has a larger outside diameter at said one end adjacent said collar than at said opposite end.

10. A grip assembly as set forth in claim 8 wherein said interior wall is tapered from said one end to said opposite end.

11. A grip assembly as set forth in claim 8 wherein said interior wall is of stepped configuration.

12. A grip assembly as set forth in claim 8 wherein said interior wall has a toughened surface at said opposite end for engaging on said flange.

13. A grip assembly comprising:

a one piece base member having a barrel defining a bore, a radially directed shoulder at one end of said barrel and a radially directed flange at an opposite end of said barrel; and a cover member telescopically disposed over said base member, said cover member being radially spaced from said barrel to define an annular chamber therewith, said cover member having one end thereof disposed on said shoulder and an opposite end disposed on said flange in an interference-fit relation.

14. A grip assembly as set forth in claim 13 wherein said barrel has an externally threaded stem at said opposite end with an annular groove to receive a sealing ring therein.

15. A grip assembly as set forth in claim 13 wherein said base member has a radially directed rib at an intermediate point slidably receiving said cover member thereon.

16. A grip assembly as set forth in claim 13 wherein said barrel has an end wall with an annular groove therein to receive a sealing ring.

17. A grip assembly as set forth in claim 16 wherein said base member includes an internally threaded collar at said one end for receiving a threaded spray head unit therein.

18. In combination, a hose assembly having a fitting at one end for delivering water therefrom;

a spray head unit for spraying streams of water therefrom; and a grip assembly coupling said hose assembly to said spray head unit, said grip assembly including a one piece base member having a barrel defining a bore, an annular shoulder at one end of said barrel, an annular flange at an opposite end of said barrel, a stem at one end coupled to said fitting for delivering water into said bore and a collar at an opposite end coupled to said spray head unit to deliver water from said bore into said spray head unit and a cover member telescopically disposed over said base member in spaced relation to said barrel to define an annular chamber, said cover member having one end disposed on said shoulder and an opposite end disposed on said flange in interference-fit relation.

19. A grip assembly for a spray head assembly, said grip assembly comprising a first tubular member having a barrel defining a central bore for passage of hot water therethrough, an externally threaded stem at one end of said barrel, an internally threaded enlarged collar at an opposite end of said barrel and a radially directed flange adjacent said stem; and a second tubular member telescopically disposed over said first tubular member, said second tubular member being secured on and to said flange in an interference fit relation and being radially spaced from said barrel of said first tubular member to define an annular chamber therebetween and having said threaded stem of said first member extending therefrom.

20. A grip assembly as set forth in claim 19 wherein said flange has a radially directed projection thereon and said second tubular member has an internal recess receiving said projection to prevent rotation of said second tubular member relative to said first tubular member.

21. A grip assembly as set forth in claim 19 wherein said barrel has an outside diameter of 0.64 inches and said chamber has an annular height tapering from 0.15 inch at one end to 0.12 inch at an opposite end.

* * * * *